US005248269A

United States Patent [19]

Artenian

[11] Patent Number: 5,248,269

[45] Date of Patent: Sep. 28, 1993

[54] CUP TERMINAL

[75] Inventor: Harry Artenian, Phoenix, Ariz.

[73] Assignee: Honeywell Inc., Minneapolis, Minn.

[21] Appl. No.: 12,612

[22] Filed: Feb. 1, 1993

Related U.S. Application Data

[63] Continuation of Ser. No. 943,074, Sep. 10, 1992, abandoned.

[51] Int. Cl.[5] ..... H01R 4/44

[52] U.S. Cl. ..... 439/801; 439/888

[58] Field of Search ..... 439/125, 126, 755, 801, 439/805, 808, 810, 811, 815, 860, 868, 888

[56] References Cited

U.S. PATENT DOCUMENTS

| | | | |
|---|---|---|---|
| D. 184,995 | 4/1959 | Gibson . | |
| D. 296,547 | 7/1988 | Sachs . | |
| 1,321,880 | 11/1919 | Benjamin | 439/808 |
| 1,848,759 | 3/1932 | Wiegand | 439/808 X |
| 2,055,130 | 9/1936 | Hotchkin . | |
| 2,314,079 | 3/1943 | Cox | 439/801 X |
| 2,509,701 | 5/1950 | Smith . | |
| 2,882,332 | 4/1959 | Reisinger . | |
| 2,994,330 | 7/1960 | Swick . | |
| 3,014,086 | 12/1961 | Schmid . | |
| 3,560,630 | 2/1971 | Heather . | |
| 3,798,347 | 3/1974 | Harding et al. . | |
| 3,937,551 | 4/1974 | Persson . | |
| 4,141,544 | 4/1979 | Riff . | |
| 5,037,333 | 8/1991 | Baubles | 439/801 X |

*Primary Examiner*—Eugene F. Desmond

*Attorney, Agent, or Firm*—Gregory A. Bruns

[57] ABSTRACT

An electric terminal for making an electrical connection to a threaded member includes a flat base having an opening for the threaded member, a generally cylindrical wall portion extending from the perimeter of the base, and holes for receiving and retaining a conductor.

2 Claims, 2 Drawing Sheets

CUP TERMINAL

This is a continuation of application Ser. No. 943,074, filed Sep. 10, 1992, now abandoned.

BACKGROUND OF THE INVENTION

The present invention relates generally to electric terminals and particularly to electric terminals for making an electrical connection to a threaded member.

A typical prior art approach to the problem of making an electrical connection to a threaded member is shown in FIG. 1 where stud type diode 40 and stud type diode 45 are to be mounted to bracket 42 through opening 44. When threaded portion 46 of diode 40 is electrically hot it must be insulated from bracket 42. Assembly parts for mounting diodes 40 and 45 may include insulating washer 48, insulating bushing 50, insulating washer 52, all of which may be made of mica or other suitable insulating material. Other assembly parts may include flat washer 54 and nut 56 which may be metallic. Lug terminal 60 includes mounting hole 59, conductor hole 61 and tab portion 63. Lug terminal 60 is intended to be secured to threaded portion 46 by nut 56. Assembled nut 56 forces surface 38 of diode 40 against surface 41 of bracket 42. Assembled nut 56 also insulating washer 48 and forces insulating washer 48 against forces insulating washer 52 against surface 43 of bracket 42 to secure diode 40 in place. Threaded portion 46 is engaged by the threads of nut 56 which makes electrical contact with threaded portion 46. Nut 56 also makes electrical contact with lug terminal 60 and secures lug terminal 60 between nut 56 and flat washer 54. After terminal lug 60 has been installed as described herein, tab portion 63 of lug terminal 60 is to be bent away from surface 43 of bracket 42 and a conductor is to be soldered to tab portion 63 at conductor hole 61. As illustrated in FIG. 1 a second stud type diode 45 is similarly mounted to bracket 42. Diode 45 is secured by nut 56' which also secures lug terminal 60,. Lug terminal 60' includes mounting hole 59', conductor hole 61, and tab 63'.

A problem with the prior art installation of FIG. 1 is that lug terminals 60 and 60' are in close proximity to surface 43 of grounded bracket 42 and therefore introduce the risk of lug terminal 60 or 60' coming in contact with surface 43 and producing a short. Typically the assembly instructions would direct the operator to bend tabs 63 and 63' of lug terminals 60 and 60' away from bracket 42 to eliminate the risk of shorting. How well the operator accomplishes these tasks determines whether a short will occur.

Bracket 42 is installed on chassis 64 as shown in FIG. 2. It is important to note that bracket 42 and chassis 64 are at ground potential while lug terminal 60 and 60' are electrically hot.

A second problem with the installation of FIG. 2 is the risk of tabs 63 and 63' being oriented so that one or the other of the tabs shorts against chassis 64. Again the assembly instructions would typically direct the operator to orient tabs 63 and 63' in a certain way. But again, how well the operator accomplishes these tasks will determine whether a short will occur.

In addition to the complications of properly bending and orienting tabs 63 and 63', the tabs increase the risk of catching items such as operator clothing, assembly tools, test tools, test leads or other items that will be near the lug terminals 60 and 60' during equipment assembly, testing or maintenance.

SUMMARY OF THE INVENTION

The present invention solves these and others needs by providing an electric terminal for making an electrical connection to an externally threaded member extending through a structure opening. The integral terminal has a flat annular base with a continuous cylindrical wall extending from the base and terminating in a continuous rim portion. An aperture having a continuous edge is provided for receiving a conductor and retaining the conductor. A separate nut secures the electric terminal to the threaded member and the threaded member to the structure.

DESCRIPTION OF THE PREFERRED EMBODIMENT

Figure 1:
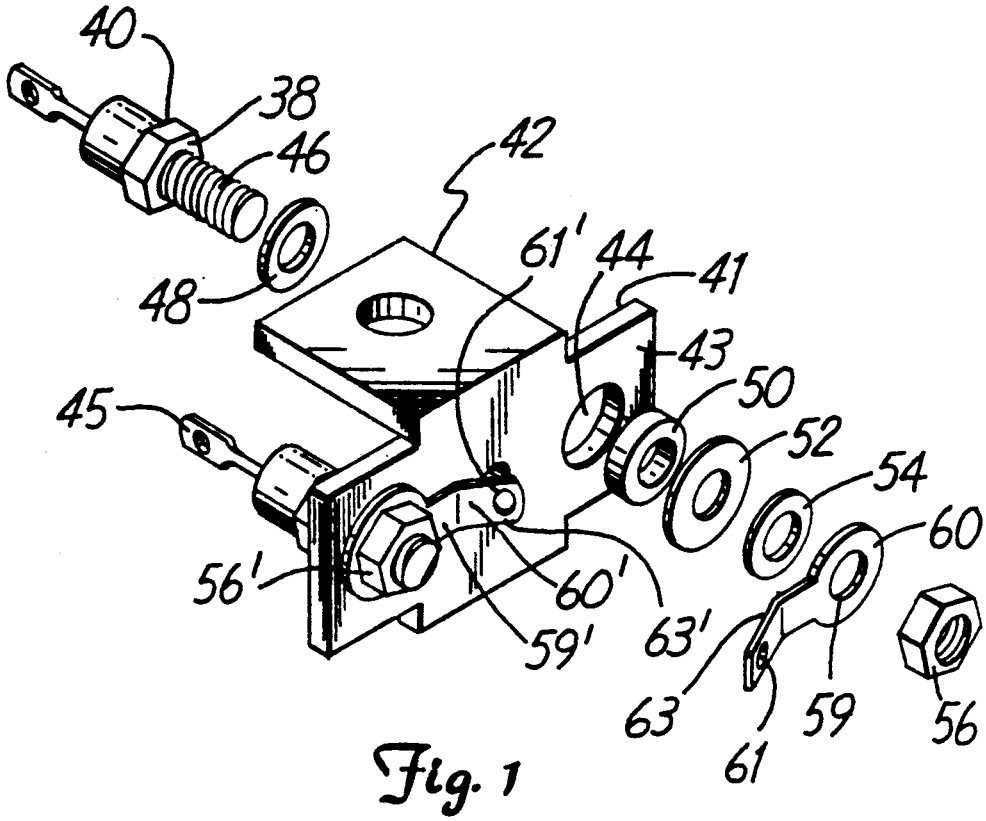
Fig. 1 PRIOR ART
FIG. 1 is an exploded perspective view of a terminal arrangement of the prior art.
Figure 2:
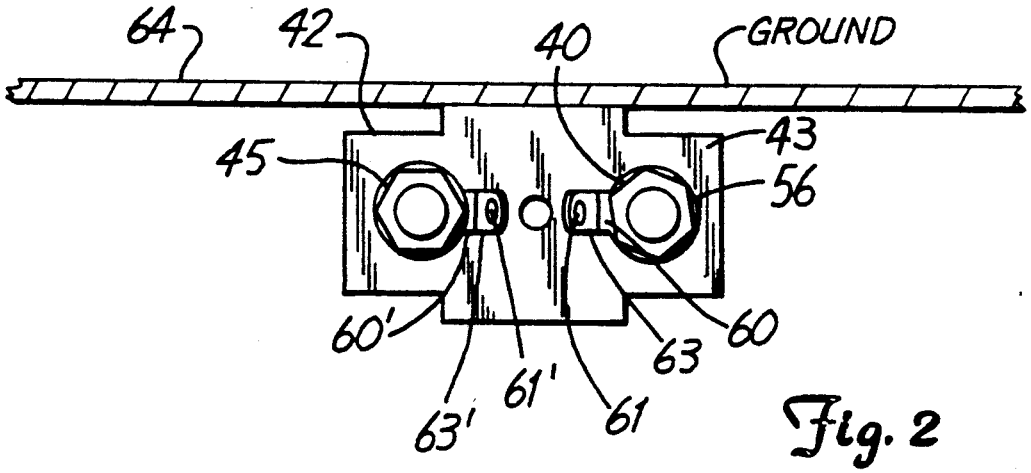
Fig. 2 PRIOR ART
FIG. 2 is a front view of the terminal arrangement of FIG. 1.
Figure 3:
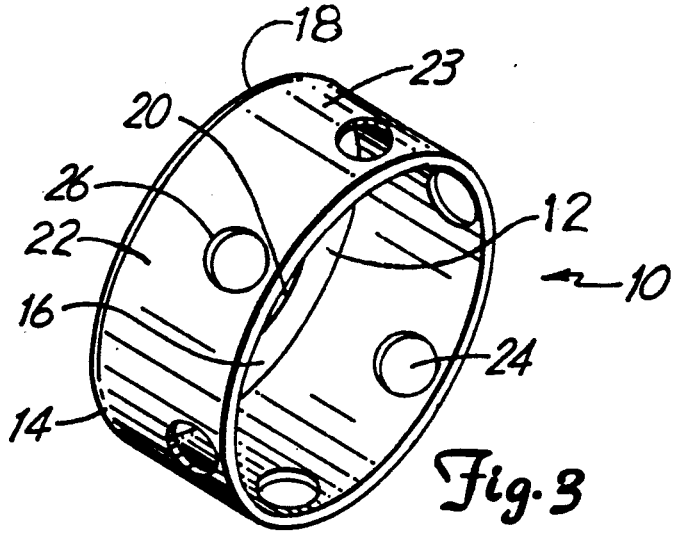
FIG. 3 is a perspective view of a cup terminal in accordance with the present invention.

An electric terminal device for making electrical connection to a threaded member is shown in the drawings and generally designated 10. Cup terminal 10 includes an annular base portion 12 having an upper surface 16 and a lower surface 18. Base portion 12 also includes hole 20. Generally cylindrical portion 22 of terminal 10 extends generally perpendicularly from perimeter 14 of base portion 12. By generally cylindrical it is meant that portion 22 has a circular cross section. Cylindrical portion 22 includes inside surface 21 and outside surface 23. Cylindrical portion 22 also includes holes 24 for receiving conductors which are secured to edges 26 of holes 24 by soldering. Cylindrical portion 22 terminates in a smooth continuous rim 28.

Figure 4:
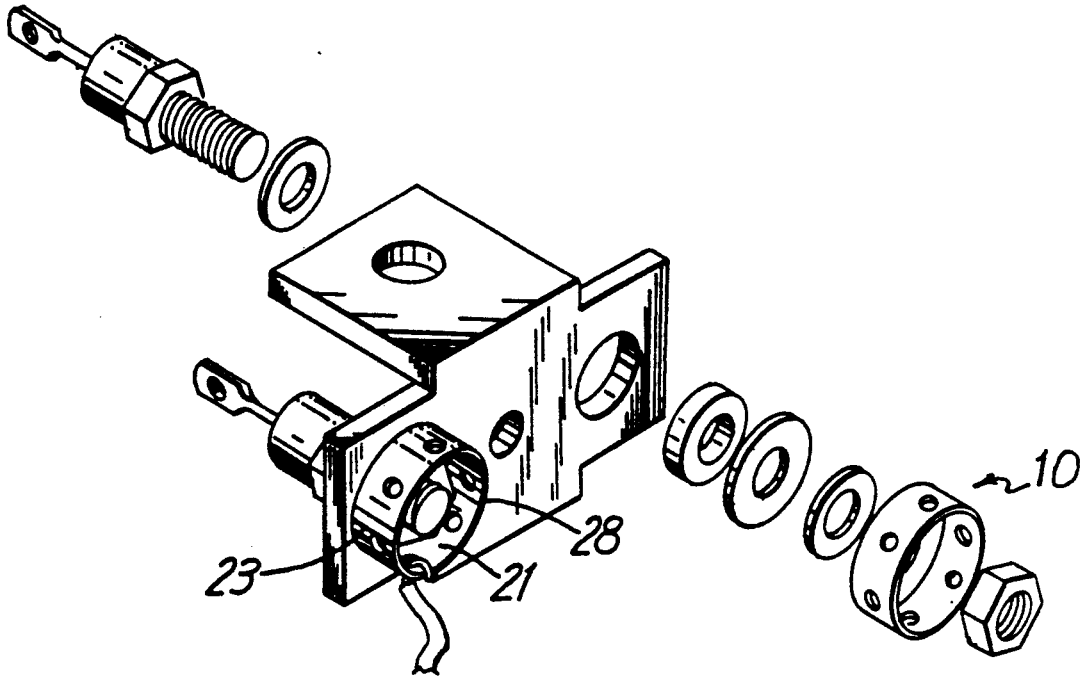
FIG. 4 is an exploded perspective view of a cup terminal in accordance with the present invention.

One embodiment of device 10 is illustrated in FIG. 4 where cup terminal 10 has been substituted for lug terminal 60. In this embodiment threaded portion 46 of diode 40 is received in hole 20 and nut 56 is threaded onto threaded portion 46. Nut 56 then abuts inside surface 16 of annular base portion 12 of cup terminal 10. When nut 56 is tightened, for example using a socket wrench, cup terminal 10 will be sandwiched between nut 56 and bracket 42.

Cup terminal 10 may be manufactured from 0.018 inch thick sheet, deep drawn copper. A finish may be hot tin dip or electrodeposited tin all over with a minimum thickness of 0.0005 thick. The material of cup terminal 10 permits it to be manufactured by a drawing process and does not require bending operations.

Now that the construction and operation of device 10 have been set forth, many advantages can be further set forth and appreciated. Cup terminal device 10 eliminates potential electrical shorts by taking the error prone bending and orientation tasks associated with lug terminal 60 away from the operator. Device 10 is essentially a circular or 360° bent lug which means the operator bending task associated with lug terminal 60 is eliminated.

Further, the axial symmetric design of device 10 allows the operator to assemble it independently of any concern about the orientation in contrast to lug terminal 60 which requires specific orientation.

The prior art also includes the approach of using a sheet metal nut adapted for having an electrical conductor connected to the sheet metal nut. A sheet metal nut requires the use of a high strength material relative to the material of cup terminal 10. The high material strength of the sheet metal nut is needed to assure that thread engaging portions of the nut have sufficient strength to transfer sufficient force from the thread engaging portion to the base of the sheet metal nut. The sheet metal nut approach also requires that some of the base sheet metal be used to form the thread engaging portions which reduces the size of the base that is used to transfer force to the abutting assembly.

In addition, where the sheet metal nut approach provides for securing a conductor to the sheet metal nut by soldering, the material strength requirements must be considered with the material solderability requirements. These somewhat opposing requirements will typically require some compromising of both strength and solderability requirements. Cup terminal 10 on the other hand may be made from copper, an ideal material for soldering.

In contrast to the reduced size of the base when using the sheet metal nut approach, cup terminal 10 also includes flat annular base portion 12 which is of sufficient area to easily transmit force from nut 56 to flat washer 54.

In addition, the present invention has the advantage of presenting only smooth rim 28 which extends above nut 56 so as to prevent the possibility of nut 56 snagging clothing items of an assembly person or servicing person. In contrast lug terminals such as 60 or 60' present sharp edges which will easily snag clothing items or test leads used in their vicinity. A sheet metal nut formed by stamping and bending will likewise present sharp edges which may snag or catch on clothing, test leads and the like.

Cup terminal 10 also includes holes 24 having continuous surrounding edges 26. A conductor received or hooked into a hole 24 will be mechanically restrained by continuous edge 26.

In accordance with the foregoing description, applicant has developed a simple cup terminal device that may be easily incorporated into designs for making electrical connection to and securing a threaded member such as a stud diode.

Although a specific embodiment of applicants cup terminal is shown and described for illustrative purposes, a number of modifications will be apparent to those of ordinary skill in the relevant arts. It is not intended that coverage be limited to the disclosed embodiment, but only by the terms of the following claims.

The embodiments of an invention in which an exclusive property or right is claimed are defined as follows:

1. An electric terminal for making an electrical connection to an externally threaded member extending through an opening in a structure with a nut securing said terminal to the threaded member and the threaded member to the structure, said electric terminal comprising;

a flat annular base portion having a perimeter and a hole for receiving said externally threaded member;

a generally cylindrical continuous wall portion extending from said perimeter and terminating in a continuous smooth rim portion;

said flat annular base portion sandwiched between the nut and the structure; and an aperture in said continuous wall portion for receiving a conductor, said aperture having a continuously surrounding edge for retaining said conductor.

2. An electric terminal for making electrical connection to a threaded member, comprising:

a flat base portion having a generally circular perimeter and a centrally located hole for receiving the threaded member;

a generally cylindrical portion having a first end and a second end, said first end connected to said generally circular perimeter, said second end terminating in a smooth continuous exposed rim; and said generally cylindrical portion further having a plurality of apertures spaced from said second end, said apertures for receiving and retaining conductors.

* * * * *